US011066207B2

(12) United States Patent
Cavaceppi et al.

(10) Patent No.: US 11,066,207 B2
(45) Date of Patent: Jul. 20, 2021

(54) HEATING CONTAINER FOR FOODS

(71) Applicants: Andrea Cavaceppi, Rome (IT); Enrico Lizzani, Rome (IT)

(72) Inventors: Andrea Cavaceppi, Rome (IT); Enrico Lizzani, Rome (IT)

( * ) Notice: Subject to any disclaimer, the term of this patent is extended or adjusted under 35 U.S.C. 154(b) by 117 days.

(21) Appl. No.: 16/095,548

(22) PCT Filed: Apr. 4, 2017

(86) PCT No.: PCT/IB2017/051921
§ 371 (c)(1),
(2) Date: Oct. 22, 2018

(87) PCT Pub. No.: WO2017/182904
PCT Pub. Date: Oct. 26, 2017

(65) Prior Publication Data

US 2019/0092516 A1 Mar. 28, 2019

(30) Foreign Application Priority Data

Apr. 20, 2016 (IT) ..... 102016000040668

(51) Int. Cl.
*B65D 81/34* (2006.01)
*B65D 5/42* (2006.01)
(Continued)

(52) U.S. Cl.
CPC ..... *B65D 5/4295* (2013.01); *B65D 5/5028* (2013.01); *B65D 81/34* (2013.01);
(Continued)

(58) Field of Classification Search
CPC ..... B65D 2585/366; B65D 5/4295
(Continued)

(56) References Cited

U.S. PATENT DOCUMENTS 5,078,050 A * 1/1992 Smith ..... A47J 39/00 126/281
5,385,292 A * 1/1995 Labianca ..... B65D 81/26 229/120

(Continued)

FOREIGN PATENT DOCUMENTS

AU 2015 100 884 A4 7/2015
CN 2038 77 214 U 10/2014
JP 2011178419 A * 9/2011

OTHER PUBLICATIONS

International Search Report, dated Jun. 12, 2017, from corresponding PCT/IB2017/051921 application.

*Primary Examiner* — Nathan J Newhouse
*Assistant Examiner* — Phillip D Schmidt
(74) *Attorney, Agent, or Firm* — Nixon & Vanderhye

(57) ABSTRACT

A heating container for foods has a common box of shape and size suitable for housing bakery products, formed by a base, a cover and lateral edges that mutually fit in a reversible manner to avoid the content outflow, including: an internal support layer, adapted to support a preheated plate at a predetermined distance from the base of the box; an air space between the base and the support layer adapted to absorb the pressures generated by the user while cutting the foods present on the plate; a preheated plate, providing a support surface for the foods, as a support for the cutting of the foods and as a heat source; and a ventilation system having holes on the cover and holes on the base, preventing condensation phenomena inside the box itself when the cover is closed.

20 Claims, 3 Drawing Sheets

(51) Int. Cl.
*B65D 81/38* (2006.01)
*B65D 5/50* (2006.01)

(52) U.S. Cl.
CPC ..... *B65D 81/3853* (2013.01); *B65D 2205/02* (2013.01); *B65D 2585/366* (2013.01)

(58) Field of Classification Search
USPC ..... 229/902–906, 120–120.1
See application file for complete search history.

(56) References Cited

U.S. PATENT DOCUMENTS

| | | | | |
|---|---|---|---|---|
| 6,386,440 | B1 * | 5/2002 | Tulkoff | B65D 5/48024 229/120.06 |
| 6,915,949 | B1 * | 7/2005 | Economopoulos | B65D 5/4295 229/120.32 |
| 7,380,702 | B2 * | 6/2008 | Oddo | B65D 5/42 229/104 |
| 8,770,466 | B1 | 7/2014 | Terlesky et al. | |
| 8,857,701 | B2 * | 10/2014 | Mandreucci | B23P 17/00 206/45.21 |
| 9,994,354 | B2 * | 6/2018 | Volpis | B65D 5/4295 |
| 2002/0040862 | A1 * | 4/2002 | Lizzio | B65D 77/0433 206/765 |
| 2003/0062406 | A1 * | 4/2003 | Lizzio | B65D 5/0015 229/120 |
| 2004/0175477 | A1 * | 9/2004 | Walter | A21C 9/04 426/549 |
| 2014/0299657 | A1 | 10/2014 | Giudilli | |
| 2016/0009440 | A1 | 1/2016 | Deiger et al. | |

* cited by examiner

HEATING CONTAINER FOR FOODS

FIELD OF THE ART

The present invention operates in the field of food packaging, and in particular it describes an innovative type of aerated and heated cardboard box that is particularly suitable for bakery products, and more in detail specific for pizza.

PRIOR ART

Pizza and bakery foods in general, which are fundamental foods for the Mediterranean diet, are mainly consumed in pizza restaurants, even if there is the increasing habit of bringing them home, where they arrived preserved in suitable cardboard boxes.

In the cardboard container, where the temperature can reach 60/65° C., the foods just exited from the oven remain there even for many minutes. Not only: often the cardboard is used for reheating the pizza or other foods in the home oven, or as tray for consumption. These habits, by now deep-rooted, can however hide several dangers. Indeed, it often occurs that by cutting the pizza into slices, making use of a knife, the bottom of the box is also cut; such box is designed only for transport of the food and not as cutting surface. Some fragments of cardboard—which are very often harmful for health—end up being accidentally swallowed by the consumer.

There are numerous patents regarding many different types of pizza boxes. By way of example, the patent AU 2015 100 884 (A4) with title "Pizza Box Bib" is reported; this describes a particular cardboard useful for the consumption of the pizza in the absence of a support surface: the base of the box is abutted against the legs of the consumer and the cover is overturned until it touches the user's chest; on the side of the cover closest to the consumer's head, a recess of the edge is provided which allows the user to eat the pizza without the annoyance of having the cover in front of his/her face, but simultaneously protecting the user's body from possible stains.

Other patents, such as CN 2038 77 214 (U), provide for boxes with double-layer closure in order to preserve the heat of the food, while other patents such as U.S. Pat. No. 8,770,466 (B1) describe boxes for the simultaneous transport of core than one pizza.

US 2014 299 657 (A1), in particular, describes the classic cardboard box for pizza made of recyclable material, provided on the bottom with an impermeable disposable sheet which serves to prevent dirtying or moistening the bottom of the box, making it reusable.

The problem of maintaining the heat seems to contrast—in all the existing embodiments of pizza boxes—with the need to ventilate the interior of the box in order to avoid condensation phenomena.

The object of the present invention is to propose a cardboard box for pizza provided with a thin pre-heated plate that maintains the pizza hot and acts as a cut-resistant surface, and simultaneously the same cardboard ensures the internal ventilation of the box by means of a plurality of holes.

DESCRIPTION OF THE INVENTION

According to the present invention, a container for foods is attained that is particularly adapted for bakery products and specifically for pizza.

The container is composed of a common box 1, provided with base 1.*a*, cover 1.*b* and lateral edges 1.*c*, made of pure cellulose and therefore adapted to preserve fatty and moist foods; such box can be advantageously achieved in any shape and size in order to be adapted to the many different types of products sold.

Like the pizza boxes that can be found on the market, also the container of the present invention is adapted to be closed in a simple and reversible manner in order to allow the transport of the foods without having them exit/escape outward.

The thickness of the box 1 is advantageously such to be able to maintain the shape of each component, even under the action of high temperatures caused by the presence of the plate 2 and of the contained foods.

Advantageously, inside said box 1, a support layer 1.*d* is present that is placed above and at a pre-established distance from the internal surface of the base 1.*a*; said support layer 1.*d* is adapted to be engaged with a plate 2.

Advantageously, on said support layer 1.*d*, a groove 1.*z* can be present at the point of contact between said support layer 1.*d* and said plate 2 that is adapted to maintain the position of said plate 2 fixed.

Advantageously said plate 2 is constituted by a surface with the preferred thickness of 5 mm adapted to be heated in the same cooking oven as the foods. The preferred material for making said plate 2 is slate, and the grounds for this lie in the fact that this material preserves heat for long periods, is non-toxic and, once cooled can be washed and reused for the same purpose. This does not limit the possibility to make said plate 2 in other polymers that have the same characteristics.

Advantageously said plate 2 can be provided with at least one hole that allows the free circulation of hot air inside the box 1. There can be more than one of said holes, advantageously, and they will have dimensions comprised between 2 mm and 5 cm, preferably 2 cm.

Advantageously, between said base 1.*a* and said support layer 1.*d*, there is an air space 6 that serves to maintain the predetermined distance between the base 1.*a* and the support layer 1.*d* even while the user is cutting the foods on the plate 2, hence exerting a certain pressure on the structure. This distance has the advantage of maintaining the base 1.*a* at a temperature such that it can be abutted against the user's hand without the latter being burned, during the transport of the box 1.

Advantageously said box 1 is characterized in that it is provided with a ventilation system 3 constituted by a plurality of holes on the cover 3.*a* corresponding with a plurality of holes on the base 3.*b*. Said holes on the cover 3.*a*, when the box 1 is closed, advantageously allow the exit/outflow of the heat of the foods, preventing the formation of condensation inside the box 1. Said holes on the base 3.*b* advantageously allow the ventilation of the part below the plate 2 in order to allow the cooling thereof after the box 1 has been opened in order to consume the foods contained. Said holes on the cover 3.*a* are adapted to be perfectly aligned with the holes on the base 3.*b* when the box 1 is in completely open configuration, i.e. with the external surface of the cover 1.*b* that touches the external surface of the base 1.*a*.

Advantageously, said air space 6, during the cutting by the user which generates pressures on the support layer 1.*d*, creates a pump effect that draws air from the outside and introduces it into the holes of the ventilation system 3.

Said air space 6 can be advantageously provided with a reinforcement 5, adapted to maintain the shape, after an initial small crushing, even under strong pressures exerted on the plate 2 by the user while cutting the foods with a knife or similar tools. Said reinforcement system 5 can be advantageously constituted by stackable elements so as to be able to increase the height of the air space 6 and hence the distance between the base 1.*a* and the support layer 1.*d*.

Advantageously the cover 1.*b* of said box 1 can be provided with a support system 4 adapted to maintain the internal surface of said cover 1.*b* always separated from the contained foods, even in the case of crushing of the box 1. Said support system 4 can be advantageously constituted by one or more simple cardboard blades arranged as a cross or with "X" shape. Said support system 4 is also useful for improving the passage of air beneath the box 1 when the latter is in completely open position, i.e. when the cover 1.*b* is made to rotate 360° around one of the lateral edges 1.*c* until the external surface of the cover 1.*b* is in contact with the external surface of the base 1.*a*.

Said plate 2 can, advantageously, have round or square shape, with dimensions of the diameter or of the side comprised between 10 cm and 60 cm, preferably 35 cm.

Another advantage of said plate 2 consists of the possibility of decorating it with a serigraphy depicting a city or a particular event, for the purpose of also serving as a memento/souvenir.

DESCRIPTION OF THE FIGURES

The invention will be described hereinbelow in at least one preferred embodiment as a non-limiting example, with the aid of the enclosed figures in which.

DETAILED DESCRIPTION OF THE INVENTION

Figure 1:
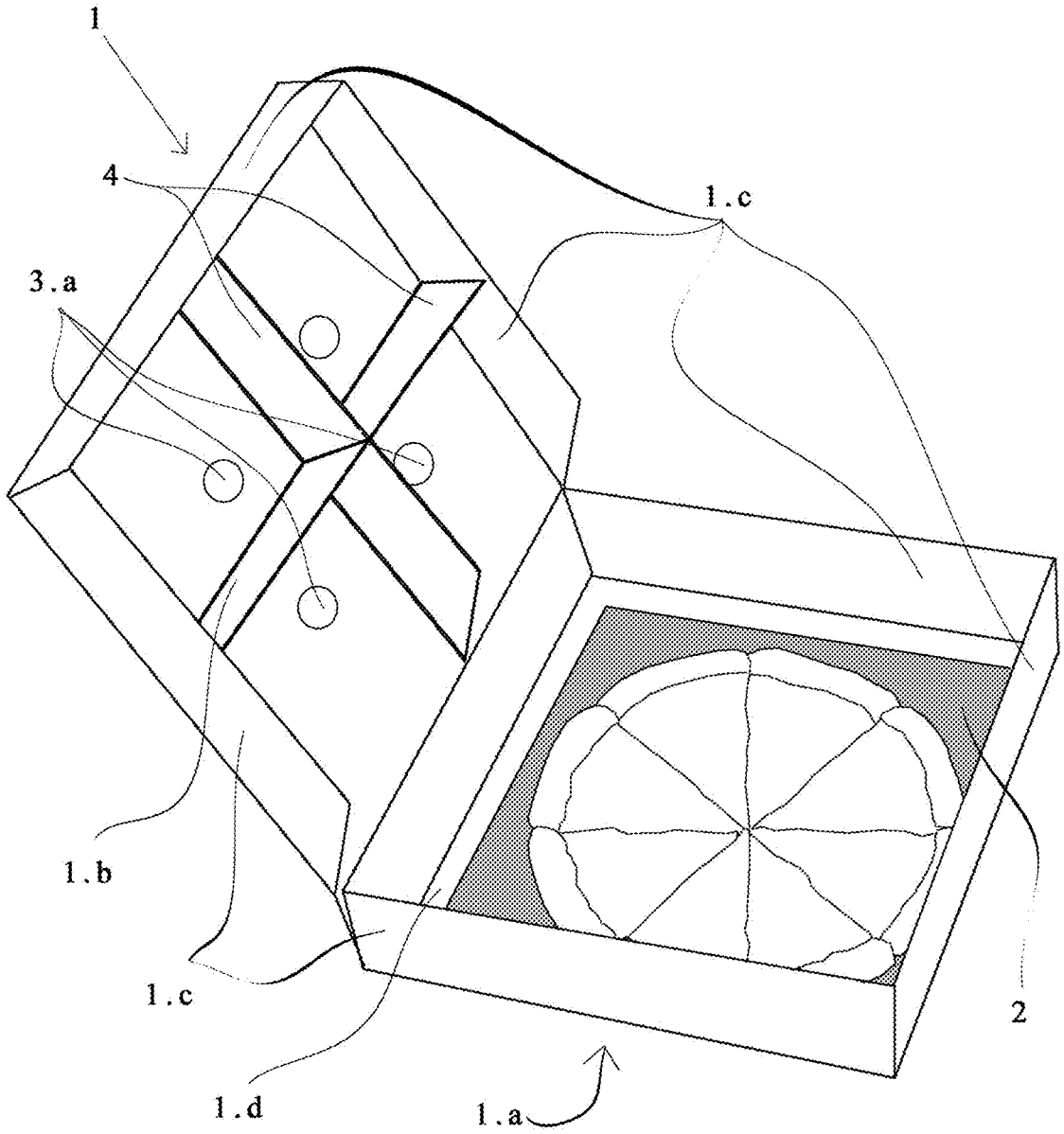
FIG. 1 shows a perspective view of the semi-open container in which one sees the box 1 composed of base 1.*a*, cover 1.*b* and lateral edges 1.*c*; above the base, one sees the support layer 1.*d* and the plate 2 made of slate represented in gray; above the plate 2, a pizza cut into slices is depicted. In this embodiment, the cover 1.*b* is provided with four holes 3.*a* of the ventilation system 3 and a support system 4 constituted by cardboard blades arranged as a cross on the internal surface of the cover 1.*b*.
Figure 2:
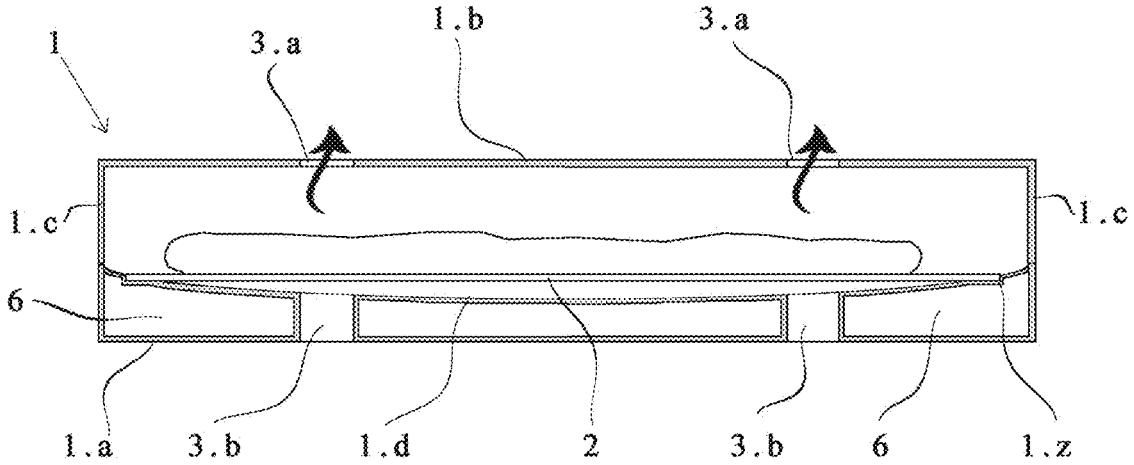
FIG. 2 shows a section of the container depicting the box 1 composed of base 1.*a*, cover 1.*b* and lateral edges 1.*c*, closed; at the interior thereof, one sees the support layer 1.*d*, with the groove 1.*z*, which supports the plate 2 on which the pizza is abutted. Between support layer 1.*d* and base 1.*a*, air space 6 is visible that is traversed by the holes on the base 3.*b*, which are vertically aligned with the holes on the cover 3.*a* from which the heat of the pizza exits, represented by the wavy arrows.

With reference to FIG. 1, the container for foods of the present invention is represented, in semi-open position and with a round pizza at its interior. The box 1 is of common type, constituted by a base 1.*a*, not visible in the figure, lateral edges 1.*c* and a cover 1.*b*., and these parts are adapted to be fit with each other in a reversible manner in order to allow closing the box 1 while, for example, it is transported from the store to home. Once the place has been reached where it is intended to eat the foods, the user opens the box 1, making the cover 1.*b* rotate 360° around one of the lateral edges 1.*c* until the external surface of said cover 1.*b* comes into contact with the external surface of the base 1.*a*.

Inside the box, the user will find the foods abutted against a thin plate 2, with preferred thickness of 5 mm, or in any case comprised between 1 mm and 10 mm, which has been heated in the same oven as the foods and which, therefore, maintains the heat thereof for a long period. This characteristic prevents the unpleasant sensation of consuming baked foods that have cooled down. Said plate 2 can have one or more holes, with preferred dimension of 2 cm, or in any case comprised between 2 mm and 5 cm, on its surface which allow the free circulation of hot air inside the box 1 and through the plate 2 itself. The preferred but non-limiting choice of slate as constituent material of the plate 2 is due not only to its property of retaining heat for a long period but also due to its non-toxicity, to its shear strength and since it can be washed and reused.

The plate 2 just described does not lie directly on the base 1.*a* of the box 1 in order to prevent overheating it; rather, it lies on a support layer 1.*d* placed at a certain distance from said base 1.*a* and separated therefrom by an air space 6. Possibly, in one possible embodiment of the present invention, said support layer 1.*d* can have a groove 1.*z* at the contact surface with said plate 2 adapted to act as an abutment for said plate 2 in order to prevent any movement thereof, except the vertical movement upward which would only occur in case of overturning of the box 1; the latter possibility is rather improbable.

Figure 4:
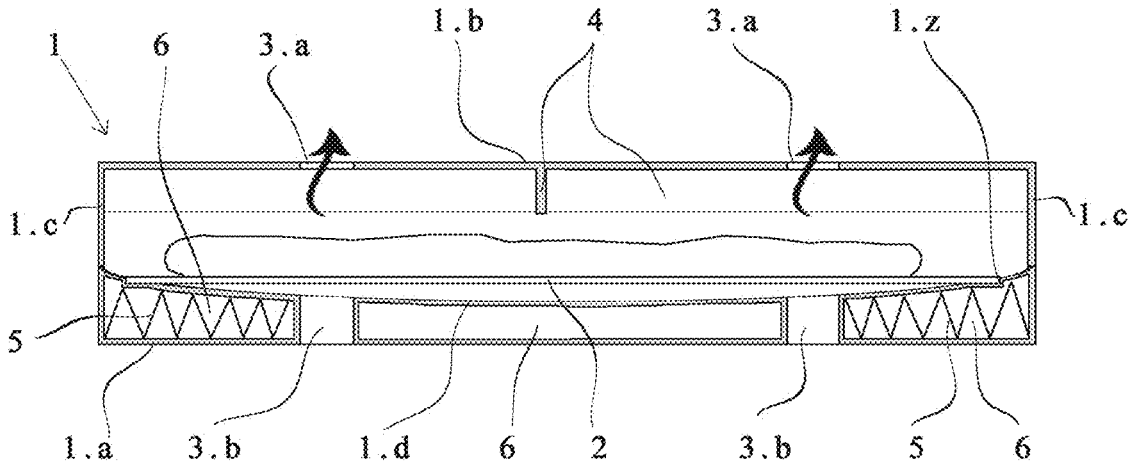
FIG. 4 illustrates a section of the container in which one sees, in closed configuration, the box 1 composed of base 1.*a*, cover 1.*b*, lateral edges 1.*c*, support layer 1.*d* with the groove 1.*z*, plate 2, ventilation system 3 with holes on the cover 3.*a* and holes on the base 3.*b* and air space 6 which, in this particular embodiment, is provided with a reinforcement structure 5; another particular feature of this version of the box 1 is the support 4 present on the internal surface of the cover 1.*b*.

The air space 6 existing between said support layer 1.*d* and said base 1.*a*, can be provided with an internal reinforcement structure 5 (FIG. 4 and FIG. 5) which serves to preserve the structure of the box 1 also under strong pressures, after a light initial crushing. Said reinforcement 5, in addition to ensuring the resistance also under strong pressures or crushing, is constituted by elements with stackable form, which allows adding already-existing reinforcement layers 5 in order to increase the height of the air space 6. This characteristic can be useful if a plate 2 is used that is particularly hot, adapted to complete the cooking of the foods and not only to maintain them at the right temperature.

Figure 3:
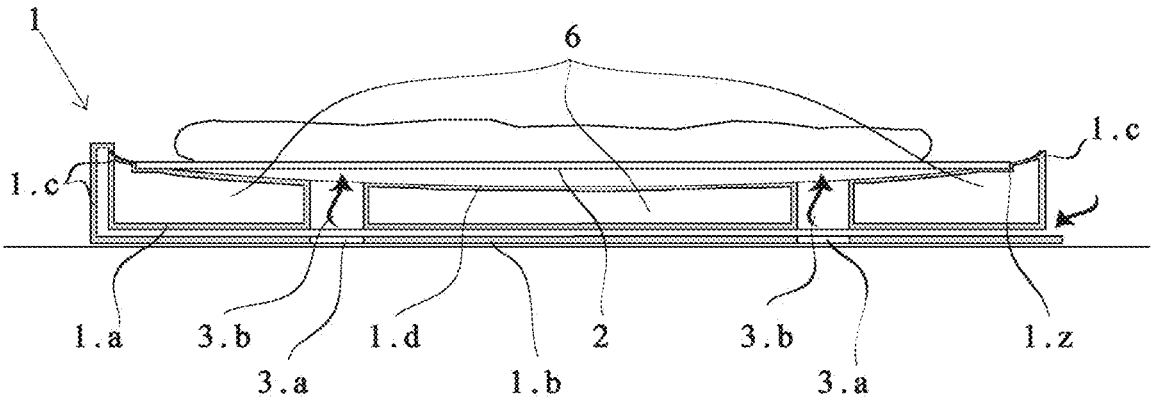
FIG. 3 shows the same version of the container described in the preceding figure in the completely open configuration with the cover 1.*b* rotated around one of the lateral edges 1.*c* until it touches the external surface of the base 1.*a*. One sees the holes on the base 3.*b* and the holes on the cover 3.*a* perfectly aligned in vertical sense in order to allow the passage of the air indicated with the wavy arrows. Also in this figure, one sees the air space 6 present between the base 1.*a* and the support layer 1.*d*, with the relative groove 1.*z*, and the plate 2 that carries the pizza.
Figure 5:
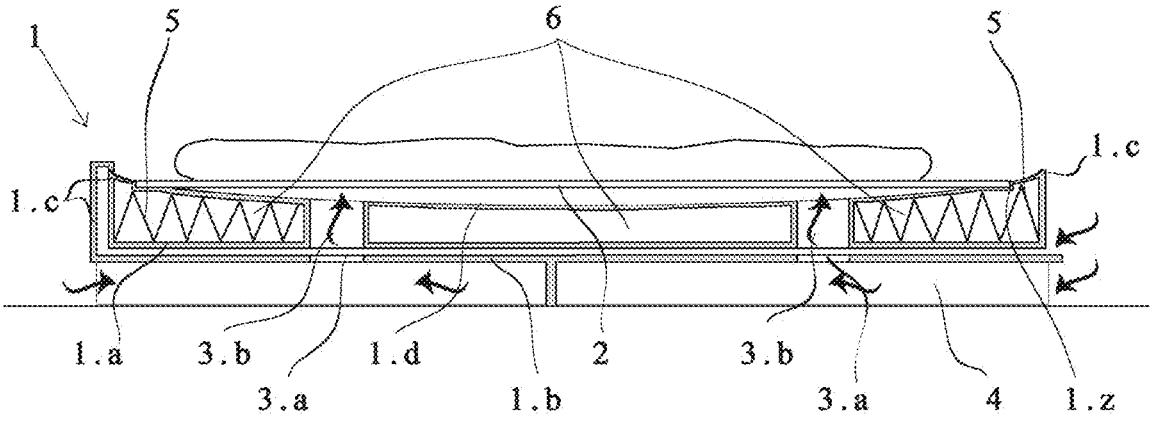
FIG. 5 illustrates the container as in the preceding figure but in completely open configuration with the cover 1.*b* rotated 360° around one of the lateral edges 1.*c* until it touches the external surface of the base 1.*a*. One sees the holes on the base 3.*b* and the holes on the cover 3.*a* perfectly aligned in vertical sense in order to allow the passage of the air indicated by the wavy arrows. One sees the air space 6 which, as in the preceding figure, is provided with a reinforcement system 5, and the plate 2 which carries the pizza. One also sees the support 4 which in open configuration acts as an abutment base against the surface of the table on which the container is placed.

It is observed that, as visible in FIG. 1, the cover is provided with a plurality of holes 3.*a* which allow the exit/outflow of the heat of the foods without condensation being formed inside the closed box 1. When the box is opened, as described, the holes on the cover 3.*a* are situated at the same number of holes on the base 3.*b* (FIG. 3 and FIG. 5). This ensures that, following the pressures due to cutting operated by the user, a pump effect is generated that draws the surrounding air into the ventilation system 3, assisting the plate 2 to be cooled more quickly. The efficiency of said ventilation system 3 is increased by the presence of a support system 4 constituted, in the preferred embodiment of the present invention, by a pair of cardboard blades arranged as a cross on the internal surface of the cover 1.*b*. This system has two uses: when the box is closed, (FIG. 4) it prevents the cover 1.*b* from touching the foods in case of crushing of the box, and when the box is completely open (FIG. 5) it determines a space between the support surface and the box 1 which allows the best operation of the ventilation system 3.

In order to be better adapted to each type of food, the plate 2 can be made both round and square, with preferred dimensions of the diameter or of the side of 35 cm, but it can be made of any other dimension comprised between 10 cm and 60 cm.

Finally, said plate 2 can be decorated by a serigraphy depicting a city or an event, in a manner such that after use, it can act as a memento/souvenir.

Finally, it is clear that modifications, additions or variations that are obvious for the man skilled in the art can be made to the invention described up to now, without departing from the protective scope provided by the enclosed claims.

The invention claimed is:

1. A heating container for foods, comprising:

a box configured to house bakery products, formed by a cover, a base that is a bottom of the heating container and opposite the cover, and a plurality of vertical side walls connecting the cover and the base, configured to be mutually fit in a reversible manner in order to avoid the content outflow;

a preheated plate configured to act as a support surface for the foods to be maintained hot, as a support for the cutting of said foods, and as a heat source to keep the foods hot or terminate the cooking thereof;

an internal support layer configured to support the preheated plate and to maintain the preheated plate at a predetermined distance from said base of said box;

an air space defined between the base of said box and said internal support layer, the air space being configured to allow the circulation of air and configured to maintain said base and said support layer spaced from each other, even under the effect of pressure generated by a user while cutting the foods present on the preheated plate; and a ventilation system, constituted by a first plurality of holes on the cover, a second plurality of holes in the support layer, and a third plurality of holes in the base, each of the second holes having a first edge portion and a second edge portion opposite the first edge portion, each of the third holes having a third edge portion and a fourth edge portion opposite the third edge portions of the respective second holes, the ventilation system including a plurality of wall portions extending between the respective first and third edge portions and the respective second and fourth edge portions, the ventilation system being configured to prevent the formation of condensation inside the box itself, when the cover is closed.

2. The heating container for foods according to claim 1, wherein said support layer for the plate is provided with a groove at the abutment surface between said support layer and said plate, the groove being configured to be engaged with the edge of said plate in order to maintain the plate in a fixed position.

3. The heating container for foods according to claim 1, wherein said air space, existing between said support layer and said base, is configured to be reversibly crushed and expanded in accordance with the pressure operated by the user for cutting the foods on the plate, generating a pump effect that draws the surrounding air into the ventilation system.

4. The heating container for foods according to claim 1, wherein the air space, existing between said support layer and said base, is provided with a reinforcement system configured to ensure the maintenance of the shape of said air space, even under strong pressures generated by the cutting of the foods present on the plate, after having been partially crushed.

5. The heating container for foods according to claim 1, wherein, when the cover of the box is opened and rotated 360° until the cover touches the external surface of the base of the box, the holes on the cover and the holes on the base are perfectly aligned.

6. The heating container for foods according to claim 1, wherein the plate has shape and size configured for the shape and size of the foods to be heated and has thickness comprised between 1 mm and 10 mm.

7. The heating container for foods according to claim 1, wherein the cover of the box is provided, in an internal surface thereof, with a support system configured to maintain a predetermined distance between the internal surface of said cover and the foods, even when the box is crushed, and when the cover is open and rotated 360° until the cover touches the external surface of the base of the box, the support system is configured to create an aerated air space between the box and the support surface, to continuously feed the foods placed above said plate with hot air.

8. The heating container for foods according to claim 1, wherein said plate is provided with at least one plate hole configured to allow the hot air to freely circulate through said plate.

9. The heating container for foods according to claim 8, wherein said plate is provided with a plurality of plate holes with diameter from 2 mm to 5 cm.

10. The heating container for foods according to claim 1, wherein the air space existing between said support layer and said base is provided with a reinforcement system constituted by stackable elements, to increase the height of said reinforcement system by superimposing two or more reinforcement systems on each other.

11. The heating container for foods according to claim 1, wherein the plate is made of any one synthetic or natural plastic polymer configured to preserve and retain heat.

12. The heating container for foods according to claim 1, wherein the plate is provided with a serigraphy that recalls monuments of the city in which the food is consumed or particular events.

13. The heating container for foods according to claim 1, wherein the plate is round, with diameter comprised between 10 cm and 60 cm.

14. The heating container for foods according to claim 2, wherein said air space, existing between said support layer and said base, is configured to be reversibly crushed and expanded in accordance with the pressure operated by the user for cutting the foods on the plate, generating a pump effect that draws the surrounding air into the ventilation system.

15. The heating container of claim 13, wherein the plate diameter is 35 cm.

16. The heating container for foods according to claim 1, wherein the plate is square, each side having a length between 10 cm and 60 cm.

17. The heating container for foods according to claim 16, wherein each of the sides has a length of 35 cm.

18. The heating container for foods according to claim 11, wherein the plate is made of slate.

19. The heating container for foods according to claim 9, wherein each of the holes has a diameter of 2 cm.

20. The heating container for foods according to claim 6, wherein the plate has thickness of 5 mm.

* * * * *